US006782301B2

(12) United States Patent
Maruyama

(10) Patent No.: US 6,782,301 B2
(45) Date of Patent: Aug. 24, 2004

(54) METHOD FOR SELECTING CENTRIFUGAL FLUID MACHINE BY COMPUTER

(75) Inventor: Junji Maruyama, Tokyo (JP)

(73) Assignee: Ebara Corporation, Tokyo (JP)

( * ) Notice: Subject to any disclaimer, the term of this patent is extended or adjusted under 35 U.S.C. 154(b) by 157 days.

(21) Appl. No.: 10/169,908

(22) PCT Filed: Jan. 12, 2001

(86) PCT No.: PCT/JP01/00128

§ 371 (c)(1),
(2), (4) Date: Sep. 13, 2002

(87) PCT Pub. No.: WO01/51815

PCT Pub. Date: Jul. 19, 2001

(65) Prior Publication Data

US 2003/0031552 A1 Feb. 13, 2003

(30) Foreign Application Priority Data

Jan. 12, 2000 (JP) ..... 2000-003312

(51) Int. Cl.[7] ..... G06F 19/00
(52) U.S. Cl. ..... 700/97; 700/95
(58) Field of Search ..... 700/97, 90, 95, 700/117; 705/26, 27; 415/232, 1

(56) References Cited

U.S. PATENT DOCUMENTS 5,504,687 A * 4/1996 Wolf ..... 700/95
6,173,210 B1 * 1/2001 Bjornson et al. ..... 700/99

FOREIGN PATENT DOCUMENTS

JP 5-202538 8/1993

OTHER PUBLICATIONS

Pump to sono Shiyouhou, the 4th printing, (Japan), Maruzen K.K., Jun. 5, 1960, pp. 256–259.
Chapter 9, "Pump Selection", pp. 226–239.
Karge, Samuel D., "*Computerized Tools Enhance Production Selection for the Water Treatment Industry*", Water Conditioning & Purification Magazine, Jul. 1, 1999.
"*Free Pump Selection Software Simplifies Ordering Process*", Osmonics Press Release, Dec. 21, 1999.
Dickenson, T.C., "*Pumping Manual 9th Edition*", 1995, Elsevier Advanced Technology, Oxford, UK, pp. 154–155.

* cited by examiner

*Primary Examiner*—Leo Picard
*Assistant Examiner*—Ryan Jarrett
(74) *Attorney, Agent, or Firm*—Wenderoth, Lind & Ponack, L.L.P.

(57) ABSTRACT

An apparatus for selecting a centrifugal fluid machine according to the present invention can easily select a centrifugal fluid machine having a required performance from among a plurality of centrifugal fluid machines having an order of priority. The apparatus (1) for selecting a centrifugal fluid machine comprises an input device (12) for inputting required performance data for a centrifugal fluid machine and a storage device (16) for storing data (162) regarding respective performance ranges and selection priorities (163) for the respective centrifugal fluid machines. The apparatus (1) for selecting a centrifugal fluid machine further comprises a selecting unit (111) for selecting a centrifugal fluid machine by determining which of the performance ranges stored in the storage device for the plurality of centrifugal fluid machines satisfies the inputted performance data, in order of higher selection priority stored in the storage device, and an output device (13) for outputting data for the centrifugal fluid machine selected by said selecting unit.

3 Claims, 4 Drawing Sheets

METHOD FOR SELECTING CENTRIFUGAL FLUID MACHINE BY COMPUTER

TECHNICAL FIELD

The present invention relates to an apparatus for selecting a centrifugal fluid machine having a required performance from among a plurality of centrifugal fluid machines. The present invention also relates to a computer-implemented method for selecting a centrifugal fluid machine, and a computer-readable storage medium having a program recorded thereon for selecting a centrifugal fluid machine.

BACKGROUND ART

Centrifugal fluid machines, e.g., pumps, have a performance range for which they are suited. This performance range can be described more specifically in terms of flow-head characteristics (Q-H characteristics). As shown in FIG. 4, a performance range suitable for a particular pump includes flow rates and heads located between a Q-H characteristic curve Y1 with an impeller having a diameter of 100 mm and a Q-H characteristic curve Y2 with an impeller having a diameter of 50 mm, or half the size, in the cases where parts other than an impeller housed in a pump casing are not changed, but the impeller is changed only in diameter. Left and right solid lines STA and END that are shown in FIG. 4 are a starting line and an ending line, respectively. Even if a pump satisfies the required performance (e.g., flow rate and head), the efficiency of the pump is decreased when the flow rate is too large or too small. Operation of a pump in an inefficient state increases the running cost and the like. Therefore, the starting line STA and the ending line END are provided in order not to include this operating region in the performance range of the pump.

When customers have requested a pump having a prescribed performance (for example, desired flow rate and head), the most effective pump (pump diameter and model number) having the required performance has heretofore been selected from numerous types of pumps in the following manner.

The performance ranges for respective pumps which are different from each other are prestored in a storage device of a computer in the form shown in FIG. 5. In this case, the performance ranges of the respective pumps overlap one another in some areas. In the overlapped areas, one pump is preferentially selected from among the pumps having the overlapped performance ranges. The performance ranges shown in FIG. 5 are numbered from ① through ⑦ to indicate the priority of the corresponding pump. The performance ranges of pumps having a higher priority are displayed in front. In FIG. 5, the performance ranges are drawn with solid lines to indicate that they are in front of other performance ranges and with dotted lines to indicate that they are at the back of the ranges with the solid lines. The order of priority is artificially predetermined based on various conditions, for example, which diameters and models of pumps capable of providing the same performance are more cost effective.

When performance data (flow and head) requested by a customer is inputted into a computer, the computer detects which pump has a performance range that satisfies the required performance data, by comparing the inputted performance data to the data shown in FIG. 5, and then outputs the detected pump (diameter and model number).

However, the performance ranges of the respective pumps which are expressed by the data shown in FIG. 5 are complicated. The only performance ranges with simple configurations are those for pumps numbered ① and ② which have the highest priority. The performance ranges of all other pumps have more complicated forms because they are overlapped by the performance ranges of pumps having a higher priority. Therefore, complicated calculations and complicated data are required to determine whether or not the desired performance is included in these complicated areas, thereby increasing not only the complexity of the processing program, but also the time required to perform the selection process.

DISCLOSURE OF INVENTION

The present invention has been made in view of the above drawbacks. It is therefore an object of the present invention to provide an apparatus for easily selecting a centrifugal fluid machine having a required performance from among a plurality of centrifugal fluid machines having an order of priority. Another object of the present invention is to provide a computer-implemented method for selecting a centrifugal fluid machine, and a computer-readable storage medium having a program recorded thereon for selecting a centrifugal fluid machine.

In order to attain these objects, according to the present invention, there is provided an apparatus for selecting a centrifugal fluid machine having a required performance from among a plurality of centrifugal fluid machines. The apparatus comprises: an input device for inputting required performance data for a centrifugal fluid machine; a storage device for storing data regarding respective performance ranges of a plurality of centrifugal fluid machines and selection priorities for the respective centrifugal fluid machines; a selecting unit for selecting a centrifugal fluid machine by determining which of the performance ranges stored in the storage device for the plurality of centrifugal fluid machines satisfies the required performance data inputted by the input device, in order of higher selection priority stored in the storage device; and an output device for outputting data for the centrifugal fluid machine selected by the selecting unit.

Further, according to the present invention, there is provided a computer-implemented method for selecting a centrifugal fluid machine having a required performance from among a plurality of centrifugal fluid machines. The method comprises: prestoring data regarding respective performance ranges of a plurality of centrifugal fluid machines in a storage device with assigning selection priorities to the respective centrifugal fluid machines; inputting required performance data for a centrifugal fluid machine; and selecting a centrifugal fluid machine by determining which of the performance ranges stored in the storage device for the plurality of centrifugal fluid machines satisfies the inputted performance data, in order of higher selection priority stored in the storage device.

By selecting a centrifugal fluid machine in this manner, comparisons between the respective performance ranges and the required performance are simplified, so that calculations for these comparisons and the processing program are simplified. As a result, the time required to perform the selection process is shortened.

Here, the performance of the centrifugal fluid machine is the performance related to flow-head characteristics, flow-efficiency characteristics, flow-suction (NPSH) characteristics, or flow-power characteristics, for example. The performance range of the centrifugal fluid machine is the range of performance (related to flow-head characteristics, for example) suited to that particular centrifugal fluid machine.

This type of method for selecting a centrifugal fluid machine with a computer is implemented by a program for selecting a centrifugal fluid machine, which is stored on and provided by a storage medium.

Specifically, according to the present invention, there is provided a computer-readable storage medium having a program recorded thereon for executing a procedure with a computer. The procedure comprises: inputting required performance data for a centrifugal fluid machine; selecting a centrifugal fluid machine by determining which of performance ranges for a plurality of centrifugal fluid machines satisfies the inputted performance data with use of data regarding performance ranges of a plurality of centrifugal fluid machines prestored in a storage device and selection priorities for the respective centrifugal fluid machines prestored in the storage device, in order of higher selection priority stored in the storage device; and outputting data regarding the selected centrifugal fluid machine.

BEST MODE FOR CARRYING OUT THE INVENTION

An apparatus for selecting a centrifugal fluid machine according to an embodiment of the present invention will be described below in detail with reference to the accompanying drawings.

Figure 1:
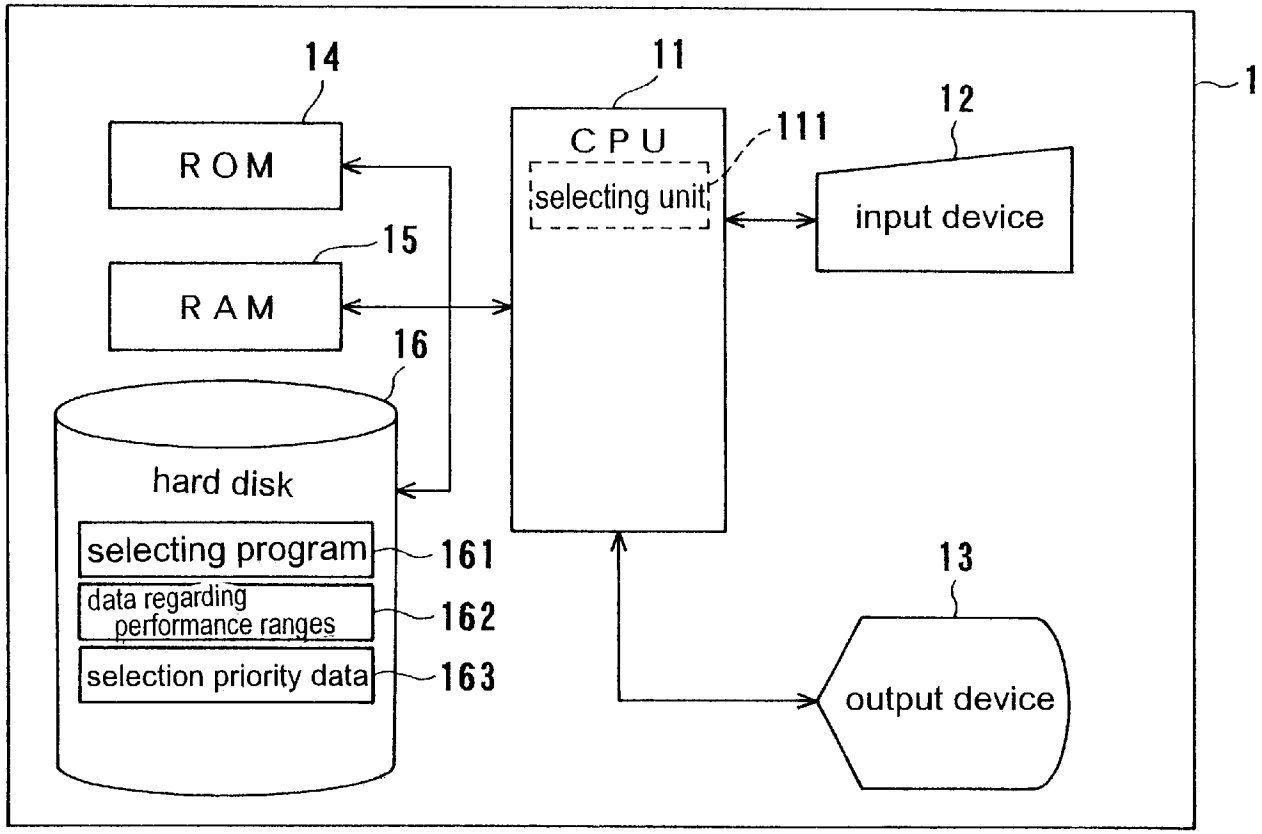
FIG. 1 is a block diagram showing an example of a hardware configuration of an apparatus for selecting a centrifugal fluid machine according to an embodiment of the present invention.

FIG. 1 is a block diagram showing an example of a hardware configuration of an apparatus for selecting a centrifugal fluid machine according to the present embodiment. The apparatus 1 for selecting a centrifugal fluid machine according to the present embodiment is configured of a common computer or the like. As shown in FIG. 1, the apparatus 1 comprises a central processing unit (CPU) 11, an input device 12 such as a keyboard or a mouse, an output device 13 such as a display, and storage devices including a ROM 14, a RAM 15, and a hard disk 16.

A computer program (selecting program) 161 for issuing commands to the CPU 11 and the like in cooperation with an operating system (OS) to perform prescribed processes is stored with the hard disk 16 in the selecting apparatus 1. The selecting program 161 is loaded into the RAM 15 and executed to constitute a selecting unit 111 (described later) in cooperation with the CPU 11 for performing the prescribed processes.

Figure 5:
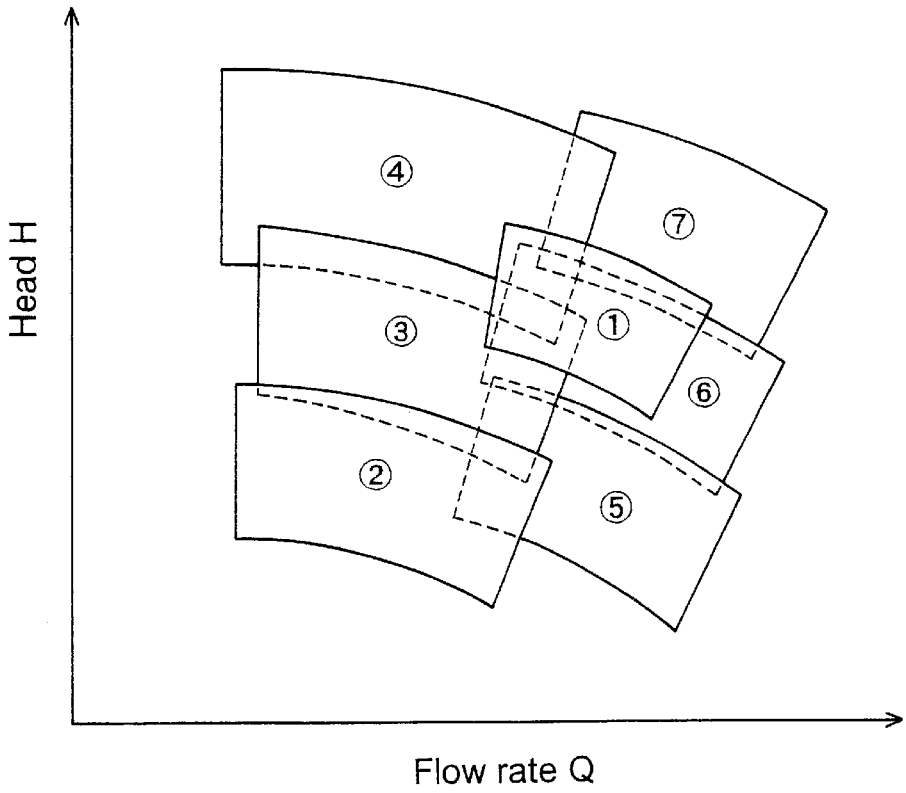
FIG. 5 is a graph showing performance ranges of a plurality of pumps differing in diameter and model.

Data 162 regarding performance ranges of a plurality of pumps are also stored as separate data in the hard disk 16 in the forms shown in FIGS. 3A through 3G, respectively. Here, FIGS. 3A through 3G show the performance ranges for a plurality of pumps (pump diameters and model numbers) in the same type (series). When the performance ranges for the plurality of pumps are superimposed on each other, they form the graph shown in FIG. 5. Instead of storing line data as shown in FIGS. 3A through 3G, a performance file containing performance data for flow rates, heads, and the like of respective pumps may be stored in the storage devices 14 through 16. In this case, the flow rate and the head may be read from the performance file as needed to generate the line data at that time. Further, a selection priority (sequence number) is preset for each pump for use in selecting a pump, and selection priority data 163 is stored in the hard disk 16. The computer program 161, the data 162 regarding the performance ranges, and the selection priority data 163 may be stored in another storage device other than the hard disk 16.

Next, the procedure for selecting a centrifugal fluid machine with use of the apparatus for selecting a centrifugal fluid machine according to the present invention will be described below.

Figure 2:
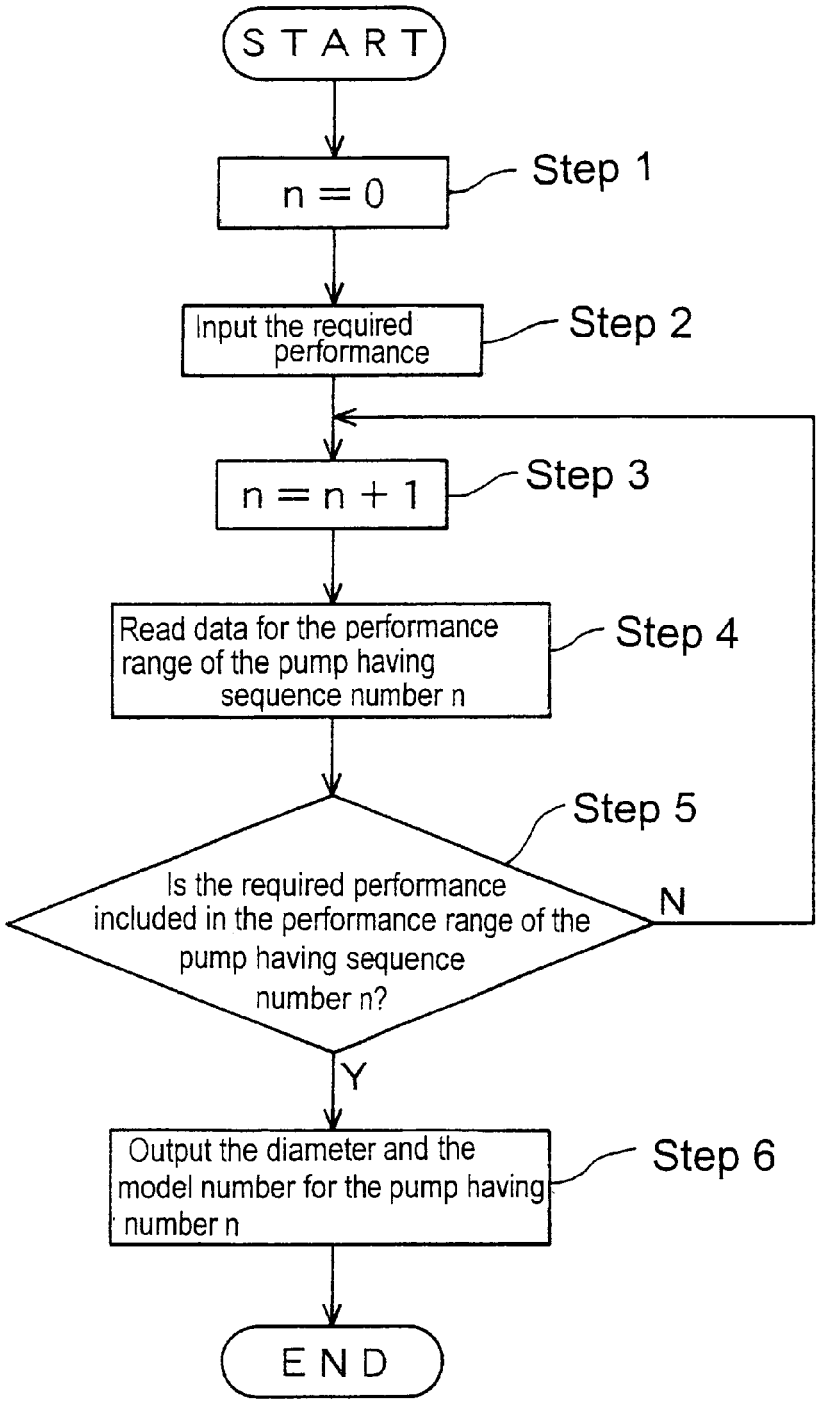
FIG. 2 is a schematic flowchart explanation of a method for selecting a pump according to the present invention.
Figure 3A:
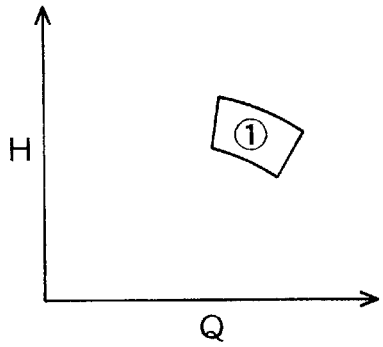
FIGS. 3A through 3G are graphs showing performance ranges of various pumps differing in diameter and model.
Figure 3B:
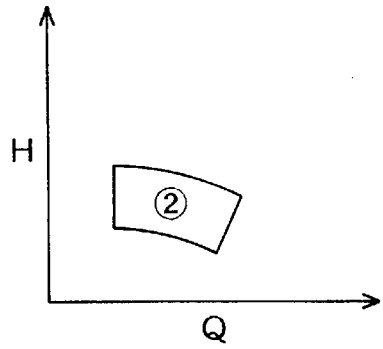
Figure 3C:
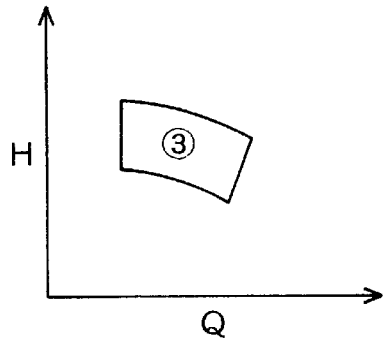
Figure 3D:
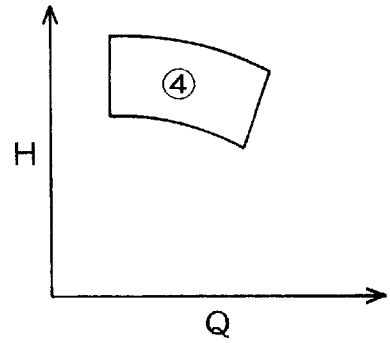
Figure 3E:
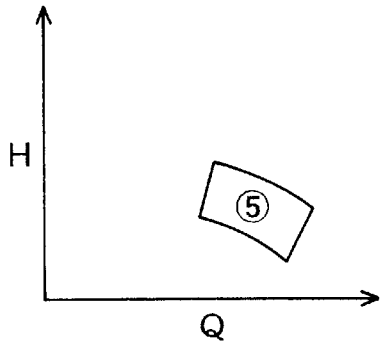
Figure 3F:
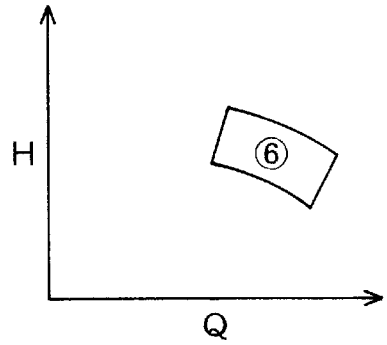
Figure 3G:
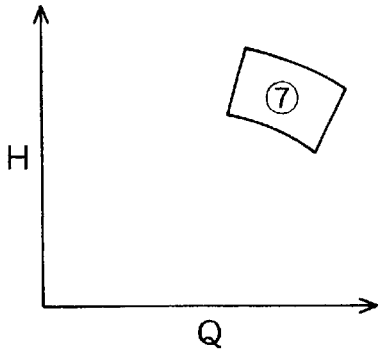
Figure 4:
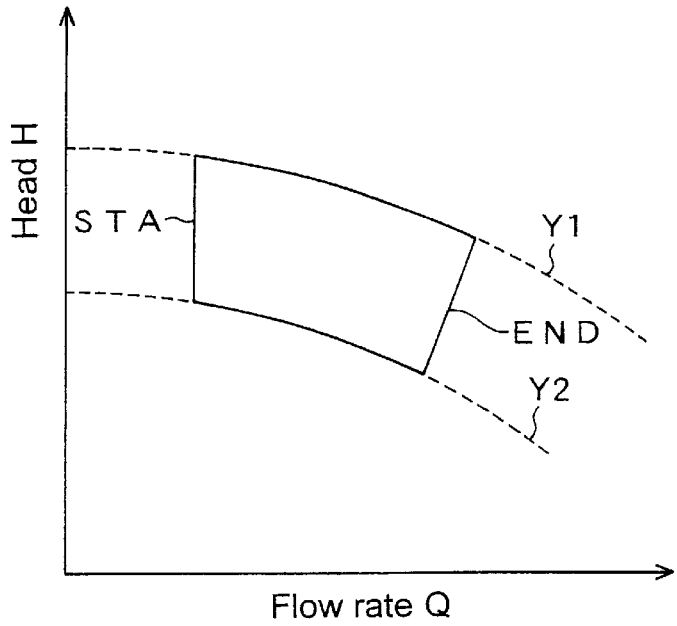
FIG. 4 is a graph showing a performance range in flow-head characteristics of one pump.

FIG. 2 is a schematic flowchart explanatory of a method for selecting a pump (centrifugal fluid machine) according to the present invention.

When a customer requests a pump having a prescribed performance, a counter n is initialized to 0 (Step 1), and the requested performance data are inputted into the selecting apparatus 1 with use of the input device 12 such as a keyboard or a mouse (Step 2), as shown in FIG. 2.

After inputting the required performance data with the input device 12, the counter n is incremented by 1 (Step 3), i.e., n=n+1, so that n=1. The selecting unit 111 reads from the storage device 16 data for the performance range of the pump having sequence number n (selection priority n) (Step 4), i.e., sequence number ①, which is the data shown in FIG. 3A.

The selecting unit 111 determines whether or not the required performance is included in the performance range read in Step 4 (Step 5). When the required performance is included in the performance range of the pump having sequence number n (number ① in this case), data for this pump having number n (number ① in this case), such as the diameter and the model number, are outputted to the output device 13 such as a display (Step 6), and then the program ends.

On the other hand, when the inputted performance is not included in the performance range of the pump having number ① in Step 5, the program returns to Step 3 and increments the counter n by 1, so that n=2. In Step 4, data for the performance range of the pump having sequence number ② is read from the storage device 16. As described above, the selecting unit 111 determines in Step 5 whether or not the required performance is included in the performance range of this pump. When the required performance is included in this performance range, the pump diameter and the model number are outputted in Step 6. When the required performance is not included in this range, the program returns to Step 3 and repeats the process, comparing the required performance to the performance range of the next pump in order of priority. The same method described above is employed repeatedly until an optimal pump is selected.

Thus, the apparatus for selecting a centrifugal fluid machine according to the present invention compares the required performance to data for the performance ranges of the respective pumps separately. Therefore, comparisons between the required performance and the respective performance ranges are simplified, so that calculations for these comparisons are simplified. As a result, the processing program is simplified, and the time required to perform the selection process is shortened.

While the present invention has been described in detail with reference to a specific embodiment thereof, it would be apparent to those skilled in the art that many modifications and variations may be made therein without departing from the spirit of the invention and the scope of which is defined by the attached claims, the specification, and the accompanying drawings.

In the above embodiment, the requested performance is compared to the performance ranges of the pumps from the highest priority to the lowest. However, the selection procedure can be configured in a variety of other patterns. For example, it may be predetermined whether or not the requested performance is included in the performance ranges of all of the respective pumps shown in FIGS. 3A through 3G, and if the requested performance is included in the performance ranges of a plurality of pumps, then the pump having the highest priority among these pumps may be selected. In other words, any procedure can be used as long as the program determines whether or not the required pump performance is included in the performance range of any of a plurality of pumps and selects a pump in order of higher priority.

Further, the required performance in the above embodiment relates to the flow-head characteristics of the pump. However, the same method of the present embodiment can be employed to facilitate selection of a pump that satisfies a required performance, even when the required performance is a different characteristic, such as flow-efficiency characteristics, flow-suction loss characteristics, or flow-power characteristics.

Furthermore, the present invention is applicable not only to pumps, but also to other centrifugal fluid machines such as fans.

As described above in detail, the present invention has an advantageous effect that a centrifugal fluid machine having a required performance can easily be selected from among a plurality of centrifugal fluid machines having an order of priority.

Industrial Applicability

The present invention is suitable for an apparatus for selecting a centrifugal fluid machine having a required performance from among a plurality of centrifugal fluid machines, a computer-implemented method for selecting a centrifugal fluid machine, and a computer-readable storage medium having a program recorded thereon for selecting a centrifugal fluid machine.

What is claimed is:

1. An apparatus operable to select a centrifugal fluid machine having a required performance from among a plurality of centrifugal fluid machines, said apparatus comprising:

an input device operable to input required performance data for a centrifugal machine;

a storage device operable to store data regarding respective performance ranges of a plurality of centrifugal fluid machines and selection priorities for the respective centrifugal machines, each performance range being represented in a flow-head characteristic graph as an area surrounded by four curves;

a selecting unit operable to select a centrifugal fluid machine by determining which of the stored performance ranges satisfies the inputted required performance data based on the stored selection priority; and an output device for outputting data for the centrifugal fluid machine selected by said selecting unit.

2. A computer-implemented method for selecting a centrifugal fluid machine having a required performance from among a plurality of centrifugal fluid machines, said method comprising:

prestoring data based on respective performance ranges of a plurality of centrifugal fluid machines in a storage device and assigning selection priorities to the respective centrifugal fluid machines, the performance range being represented in a flow-head characteristic graph as an area surrounded by four curves;

inputting required performance data for a centrifugal fluid machine; ad selecting a centrifugal fluid machine by determining which of the stored performance ranges satisfies the inputted performance data based on the stored selection priority.

3. A computer-readable storage medium having a program recorded thereon for executing a procedure with a computer, said procedure comprising:

inputting required performance data for a centrifugal fluid machine;

selecting a centrifugal fluid machine by determining which performance ranges of a plurality of centrifugal fluid machines satisfies the inputted performance data of a a plurality of centrifugal fluid machines prestored in a storage device and based on selection priorities for the respective centrifugal fluid machines prestored in the storage device, the performance range being represented in a flow-head characteristic graph as an area surrounded by four curves; and outputting data regarding the selected centrifugal fluid machine.

* * * * *

UNITED STATES PATENT AND TRADEMARK OFFICE

CERTIFICATE OF CORRECTION

PATENT NO. : 6,782,301 B2
DATED : August 24, 2004
INVENTOR(S) : Junji Maruyama

It is certified that error appears in the above-identified patent and that said Letters Patent is hereby corrected as shown below:

Title page,
Item [54], Title, please change "METHOD FOR SELECTING CENTRIFUGAL FLUID MACHINE BY COMPUTER" to read -- COMPUTER-IMPLEMENTED METHOD OF SELECTING CENTRIFUGAL FLUID MACHINE --.

Column 6,
Line 28, please change "machine; ad" to read -- machine; and --.
Line 43, please change "of a a plurality" to read -- of a plurality --.

Signed and Sealed this

Twenty-third Day of November, 2004

JON W. DUDAS
*Director of the United States Patent and Trademark Office*